US007063159B2

(12) United States Patent
Patton et al.

(10) Patent No.: US 7,063,159 B2
(45) Date of Patent: Jun. 20, 2006

(54) MULTI-PURPOSE COILED TUBING HANDLING SYSTEM

(75) Inventors: Bartley J. Patton, Sugar Land, TX (US); Shampine Rod, Houston, TX (US); Nikki Hobbs, Houston, TX (US); Terry McCafferty, Brookshire, TX (US); Robin Mallalieu, Sugar Land, TX (US)

(73) Assignee: Schlumberger Technology Corp., SugarLand, TX (US)

( * ) Notice: Subject to any disclaimer, the term of this patent is extended or adjusted under 35 U.S.C. 154(b) by 1 day.

(21) Appl. No.: 10/809,256

(22) Filed: Mar. 25, 2004

(65) Prior Publication Data

US 2005/0211430 A1 Sep. 29, 2005

Related U.S. Application Data

(60) Provisional application No. 60/457,219, filed on Mar. 25, 2003.

(51) Int. Cl.
*E21B 19/09* (2006.01)

(52) U.S. Cl. ..... 166/355; 166/77.2; 166/66

(58) Field of Classification Search ..... 166/355, 166/360, 363, 364, 75.14, 77.1–77.3, 85.1, 166/66

See application file for complete search history.

(56) References Cited

U.S. PATENT DOCUMENTS

| | | | | |
|---|---|---|---|---|
| 4,421,173 | A | 12/1983 | Beakley et al. | 166/336 |
| 6,000,480 | A | 12/1999 | Eik | 173/8 |
| 6,554,075 | B1 * | 4/2003 | Fikes et al. | 166/379 |
| 6,688,814 | B1 * | 2/2004 | Wetch et al. | 405/224.2 |
| 2004/0151549 | A1 * | 8/2004 | Roodenburg et al. | 405/201 |

FOREIGN PATENT DOCUMENTS

| | | |
|---|---|---|
| GB | 2334048 | 8/1999 |
| GB | 2343466 | 5/2000 |

* cited by examiner

*Primary Examiner*—David Bagnell
*Assistant Examiner*—Nicole A Coy
(74) *Attorney, Agent, or Firm*—Rodney Warfford; Tim Curington; Robin Nava

(57) ABSTRACT

A system for reducing the effects of heave movements of a wellhead in an offshore drilling device is provided that includes a frame; a coiled tubing stack supported by the frame; and a heave compensation system for controlling an amount of load transferred from the coiled tubing stack to the wellhead to reduce relative movements between the coiled tubing stack and the wellhead.

14 Claims, 7 Drawing Sheets

MULTI-PURPOSE COILED TUBING HANDLING SYSTEM

This patent application claims priority under 35 U.S.C. § 119(e) to provisional application Ser. No. 60/457,219 filed on Mar. 25, 2003 which is incorporated herein by reference.

BACKGROUND OF TEE INVENTION

1. Field of the Invention

The present invention relates generally to an improved system for handling coiled tubing on an offshore platform or installation. More specifically, the invention is a system for reducing the load (i.e., stack weight, tubing load, etc.) on the wellhead and for providing a flexible connection between the wellhead and the coiled tubing stack.

2. Description of the Prior Art

There are three broad classes of offshore installations: floating platforms or floaters, fixed leg, and tension leg. Floating platforms are connected only to the sea floor by a marine riser. Fixed leg platforms have solid legs that reach all the way to the sea floor. Tension leg platforms (including spars) have cables that pull the buoyant structure deeper into the water.

Operations on fixed leg platforms are very similar to land operations. The only significant differences are that the work space is more limited and all of the equipment must be delivered or transported to the platform. Typically, such delivery is by boat, with the equipment being lifted into place with the platform crane.

Operating on floaters requires that the coiled tubing equipment be placed in the load path of the marine riser. This requires that a lifting frame capable of carrying 350 tons (for a typical operation) is required to allow the injector and BOPs to be isolated from this enormous load. The key challenges are getting this frame into the derrick, rigging up the coiled tubing equipment in it and connecting to the wellhead/marine riser. Once everything is rigged up, the marine riser is attached to the wellhead on the sea floor. From this point on, the floater is moving up and down with respect to the injector, with the motion being compensated for by the derrick blocks. The floater is dynamically positioned, so the riser stays vertical.

Operations on tension leg platforms (TLPs) require set-up/rig-up operations which fall between those required for floaters and fixed leg platforms. There are decks to rig up on, but the wellheads are connected to the sea floor with risers. A tensioning system ensures that this riser is always being pulled upward (to prevent it from buckling and/or being lost underwater). As the TLP is moved by waves, wind and currents, the wellhead moves relative to the TLP. On some TLPs this motion is constrained to be perpendicular to the deck. On others the wellhead pivots about a spherical joint and moves vertically. The details of the motion depend on the construction of the platform. In general, the wellhead on an off-shore platform is unable to support significant additional load (unlike typical wellheads on land). Wellhead motion, during storms for instance, can range as high as six feet and six degrees of tilt. Also, for platforms using buoyant cans to support the wellhead, the loss of one or more cans can cause the wellhead to sink as much as twenty feet. The primary challenges for this sort of platform include handling the wellhead vertical motion, angular motion, and lack of load carrying ability.

Lifting frames that carry the marine riser load around the coiled tubing equipment are currently available. Common problems with these frames include difficult rig up and difficulty getting them through the V-door and into the derrick.

For operations where the wellhead can carry the tubing load and does not tilt, compensating jacking frames may be employed. These frames prevent the coiled tubing stack from falling over and allow it to move up and down in response to the vertical motion of the wellhead.

Yet another option for handling wellhead movement is a hook load compensator. This system allows an offshore job (on a wellhead that can support load and that does not tilt) to proceed like a land job. The coiled tubing stack is attached at the top to a device that transfers force between the top of the stack and the hook of a platform crane, but still allows motion. Currently available devices do this using one or more hydraulic cylinders and hydraulic accumulators. As the cylinder is pulled out, it compresses the gas in the accumulator, increasing the force carried by the cylinder.

SUMMARY OF THE INVENTION

As previously described, there are significant problems with existing coiled tubing handling systems. The present invention provides an improved system for handling coiled tubing, particularly for off-shore applications. Without limiting the scope of the invention, the system provides a flexible connection between the wellhead and the coiled tubing stack and also includes a mechanism for reducing the load placed on the wellhead by the coiled tubing.

In order to allow movement between the wellhead and the coiled tubing unit, thereby allowing for compensation for movement of the wellhead in relation to the CT unit, a flexible connection is provided. In addition to allowing for movement of the wellhead or coiled tubing unit/BOP during operations, the flexible riser also allows for faster rig-up by decreasing the accuracy required to mate or join the coiled tubing unit to the wellhead.

The present invention comprises two primary elements. The first is a frame that follows the coiled tubing stack and transfers the stack weight, tubing load, and an additional relatively small tension to the rig's deck, rather than the wellhead. As a jacking frame the injector head is not installed in the rig, which allows for rigless operation on a TLP or SPAR. Internal compensating mechanism of the frame may feature active compensation, which maintains a constant load on wellhead under dynamic loading conditions, unlike passive compensation which keeps a general load on the wellhead within a small range of loading. As a tension lift frame the present invention functions as a tension lift frame, typically including a trolley system for injector movement. Winches on top of the lift frame may be used to raise the lower half of the tension lift frame holding the BOPs into the derrick. The second primary element of the present invention is a flexible riser that connects the wellhead to the coiled tubing stack. These two elements may be used either in combination or separately.

The present invention may also be used in a derrick where no block compensation is available, such as a spar. The frame is supported in the blocks and guide wired or otherwise secured to the derrick by other suitable mechanisms. The riser is then connected to the compensation system within the frame, thereby allowing the frame to compensate for movement of well in relation to derrick. The advantage of the present system from current systems is two fold, first movement between the wellhead and the coiled tubing unit is compensated and second the ability to fix the injector tension frame with relation to derrick, thus minimizing rocking of injector while still allowing compensation.

DETAILED DESCRIPTION OF THE PREFERRED EMBODIMENTS

Figure 1:
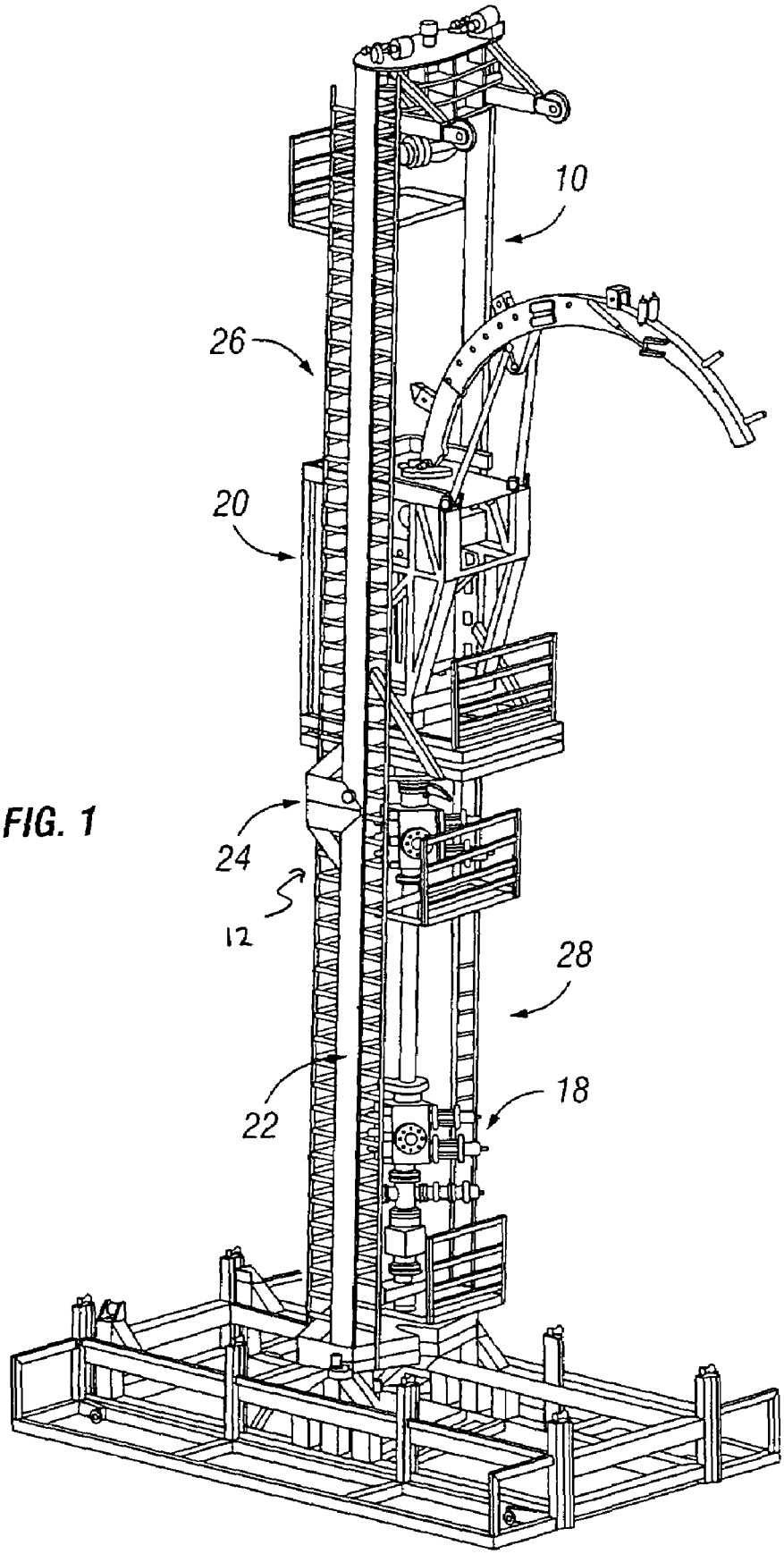
FIG. 1 is a schematic of a system for reducing the effects of heave movements of a wellhead in an offshore drilling device according to one embodiment of the invention.
Figure 2:
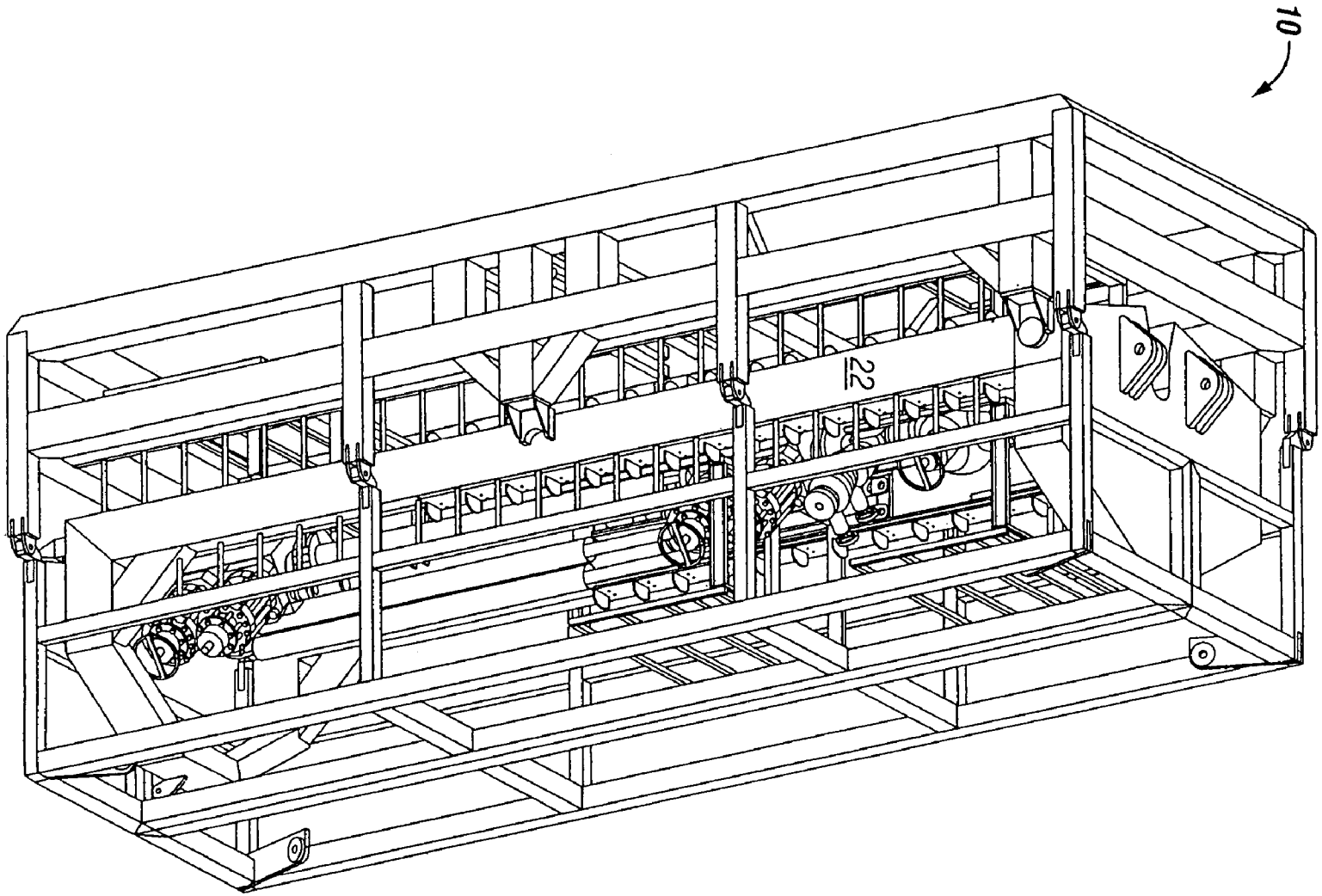
FIG. 2 is a schematic showing the frame in a folded position.
Figure 5:
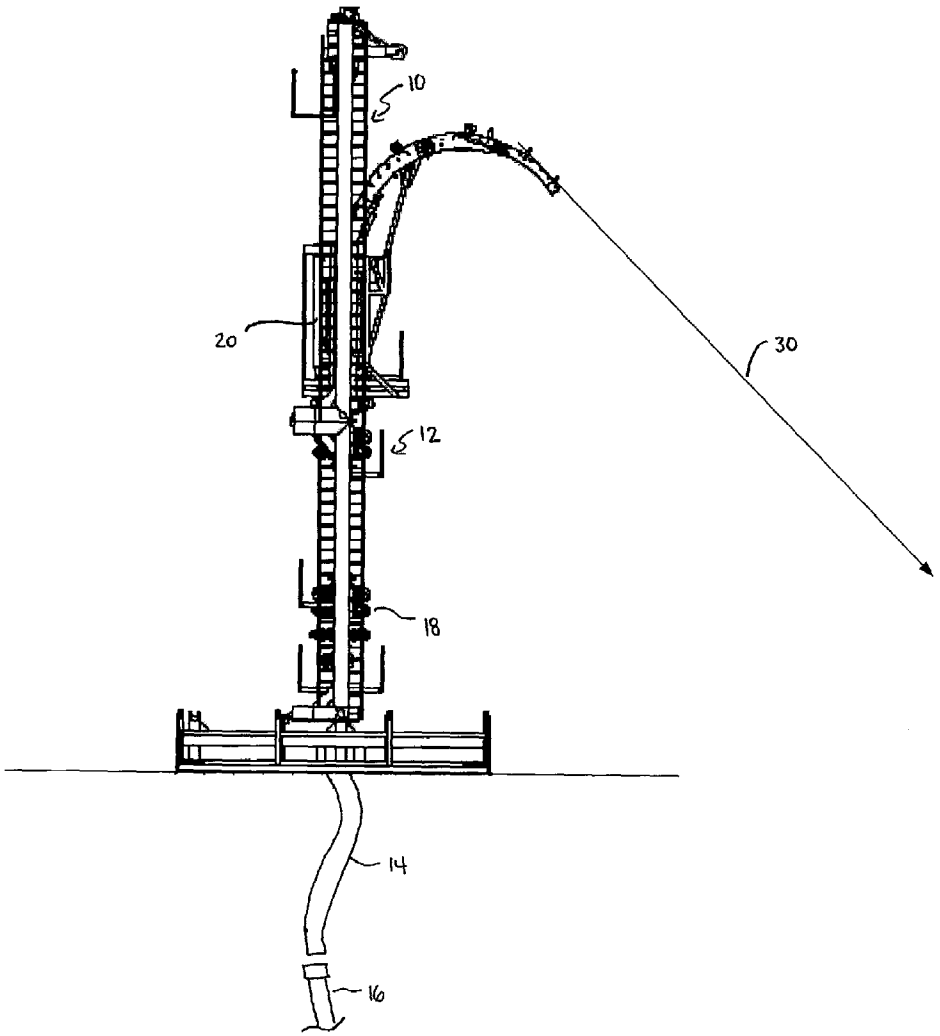
FIG. 5 is another schematic of a system for reducing the effects of heave movements of a wellhead in an offshore drilling device according to one embodiment of the inveniton. 5 is a schematic of the coiled tubing handling system.

As shown in FIGS. 1, 2 and 5, the present invention includes a frame 10, a load compensation system or mechanism 12 and a flexible riser system 14 for reducing the load on the wellhead 16 and allowing both horizontal and vertical movement between the BOPs 18, coiled tubing stack 20 and the wellhead.

The frame 10 of the invention is typically formed from plurality of steel legs; however, any suitable material may be used to form the legs. In a preferred embodiment of the invention, the frame 10 consists of two or more vertical members or legs 22. In a more preferred embodiment, the frame is a jacking frame or tension lift frame. The legs 22 may each be a single continuous unit or may include a joint 24 thereby allowing the frame to be separated into an upper half or component 26 and a lower half or component 28. In this way, the frame may be condensed, folded or disassembled when not in use, thereby significantly decreasing the space required transport the frame to and from the rig. As shown in FIGS. 1 and 2, the joint may be a hinge-type joint which allows the upper component to swing or fold into a position substantially parallel and adjacent to the lower component. Alternatively, the joint may allow the two components to be completely separated and moved or transported individually.

Figure 3:
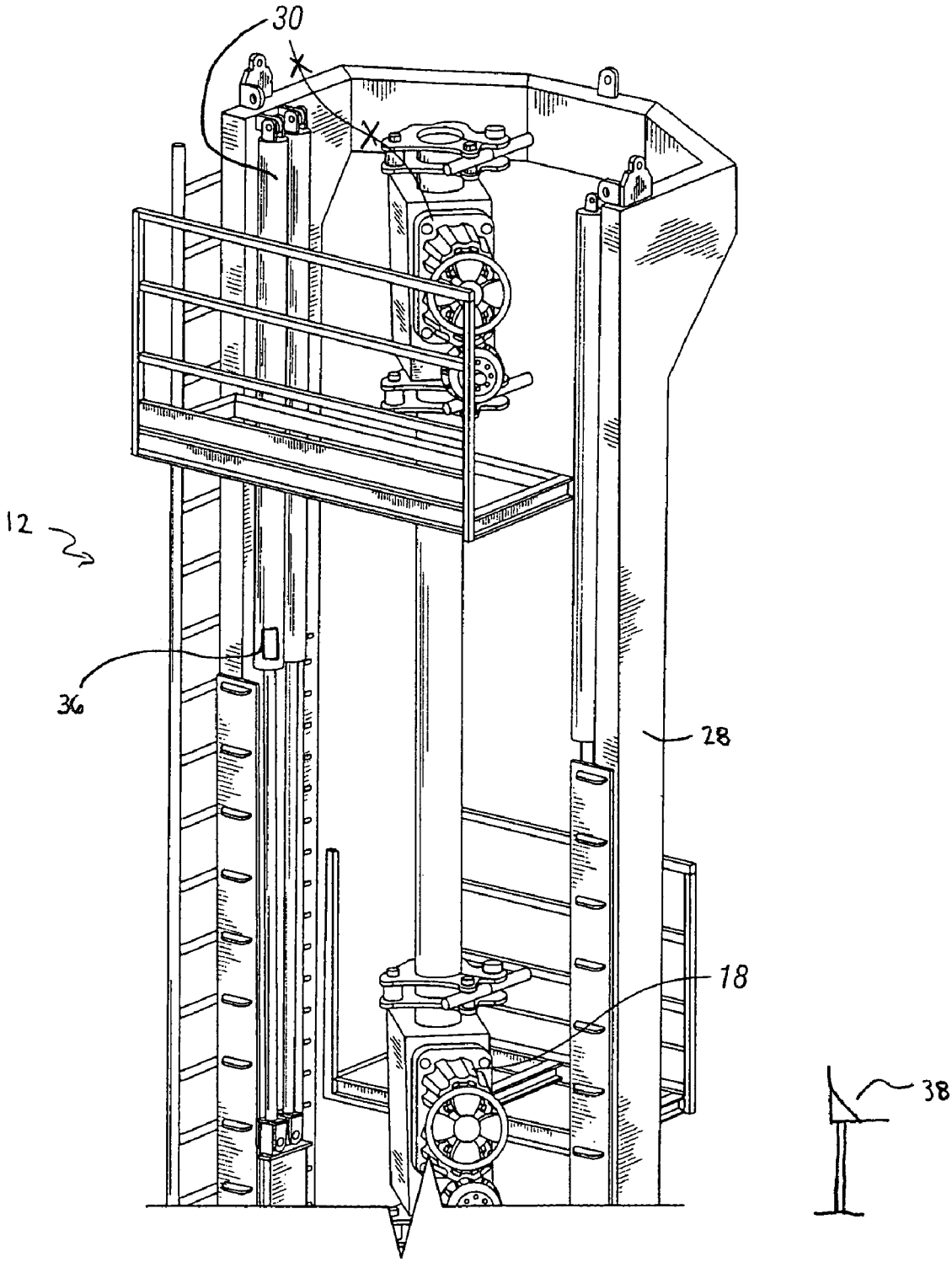
FIG. 3 is a schematic showing the compensation cylinders.

The lower component 28 of the frame carries the BOP stack 18 and a compensation system 12 to transfer load from the stack 18 to the frame 10 while allowing the stack to move relative to the frame. The compensation system allows the BOP stack (which is typically attached or connected to the wellhead) to move independently of the lower component. In addition, the compensation system also transfers a portion of the load created by the BOPs, coiled tubing, etc. from the wellhead to the frame. Preferably, the compensation system comprises at least one actuator. More preferably and as shown in FIG. 3, the system includes a set of hydraulic cylinders (two or more) or a rack and pinion system located on at least one of the legs. The compensation system may carry the static weight of the BOPs 18, the coiled tubing injector 20 and the dynamic weight of the coiled tubing 30 in the well. A typical capacity for such a system is approximately 150,000 pounds; however, the system may be designed or manufactured to support or carry any load which may be encountered during coiled tubing operations.

Figure 6:
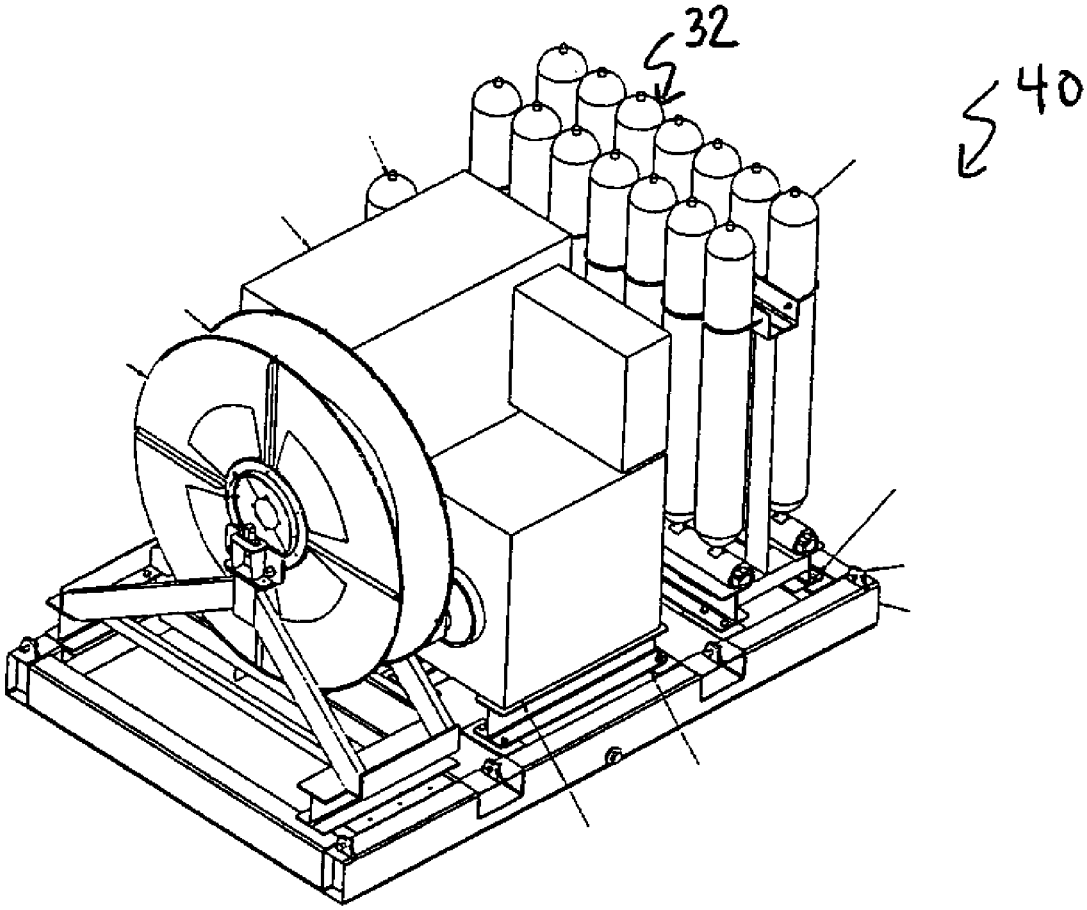
FIG. 6 is a perspective view of a power pack according to one embodiment of the invention, showing accumulators detached from their associated hydraulic cylinders.
Figure 7:
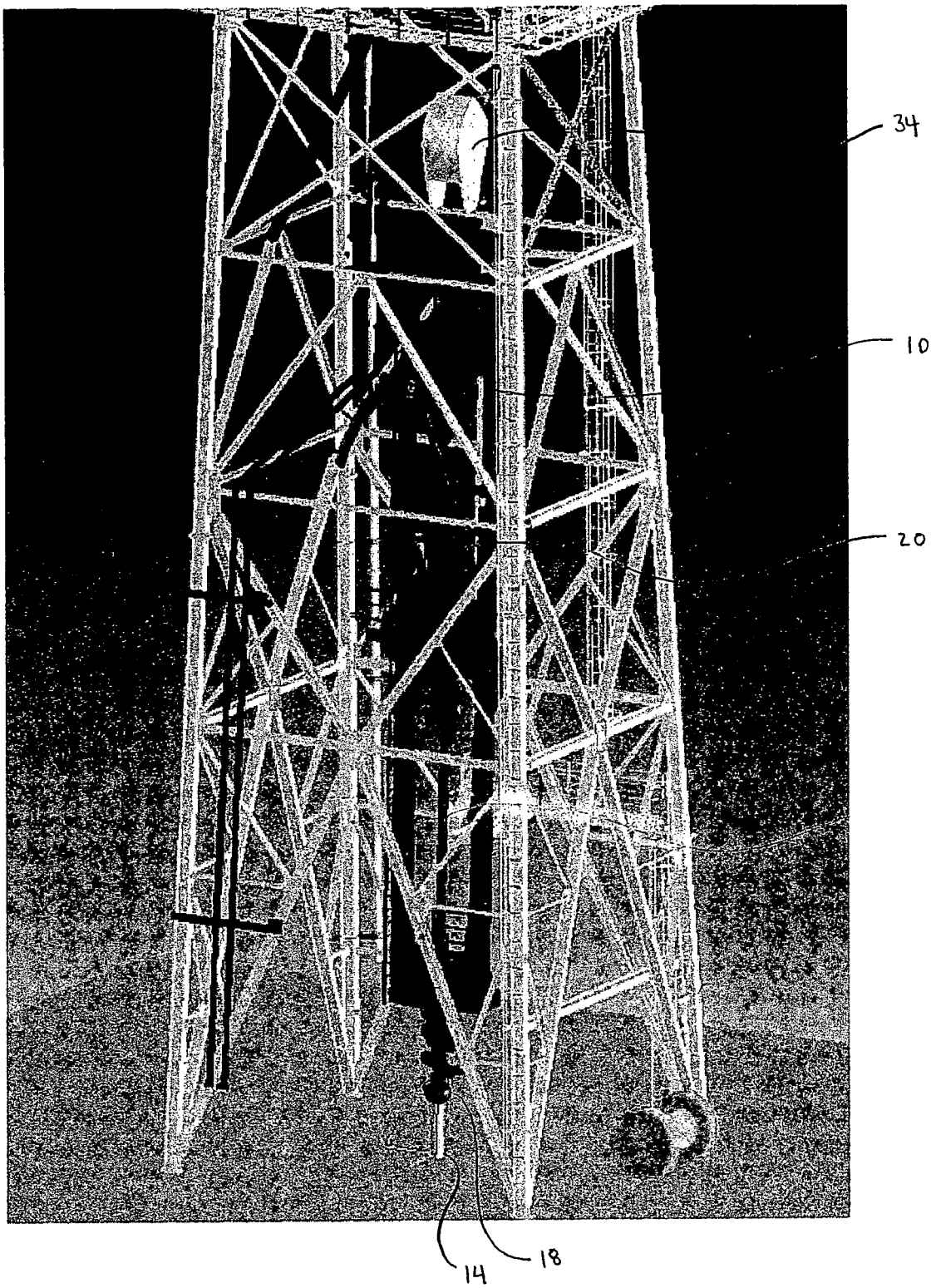
FIG. 7 is a perspective view of an alternative embodiment of the invention.
Figure 1:
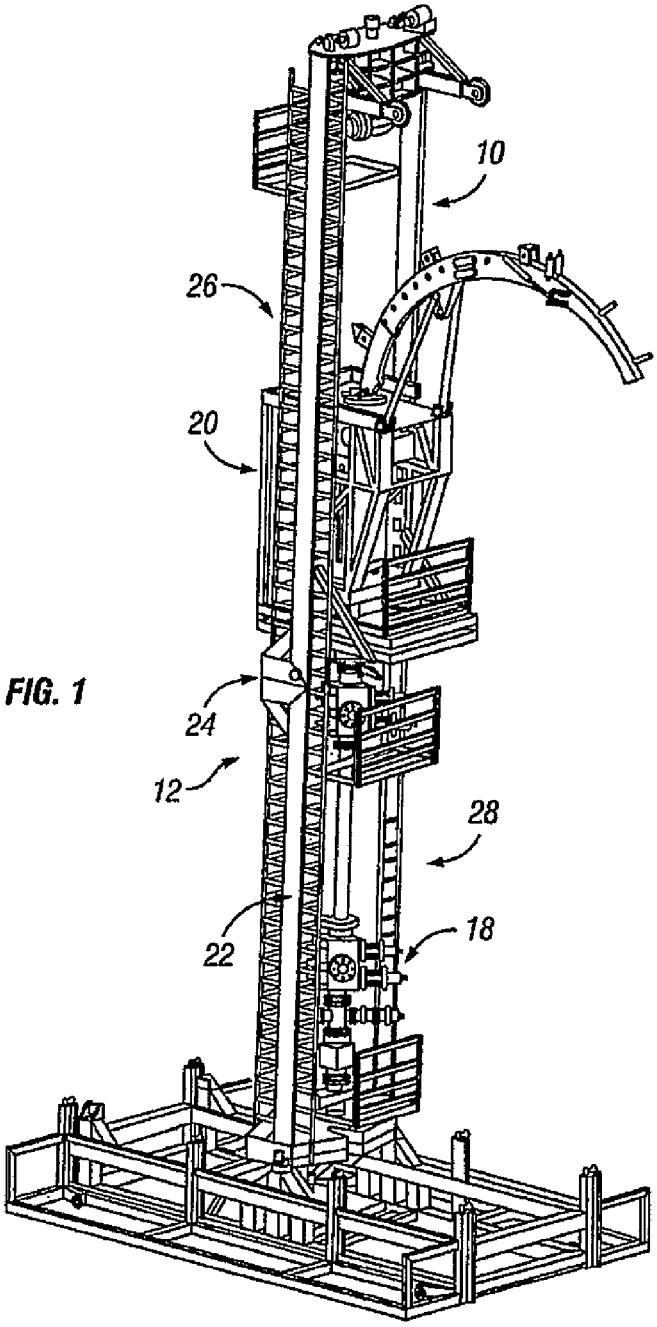
Figure 3:
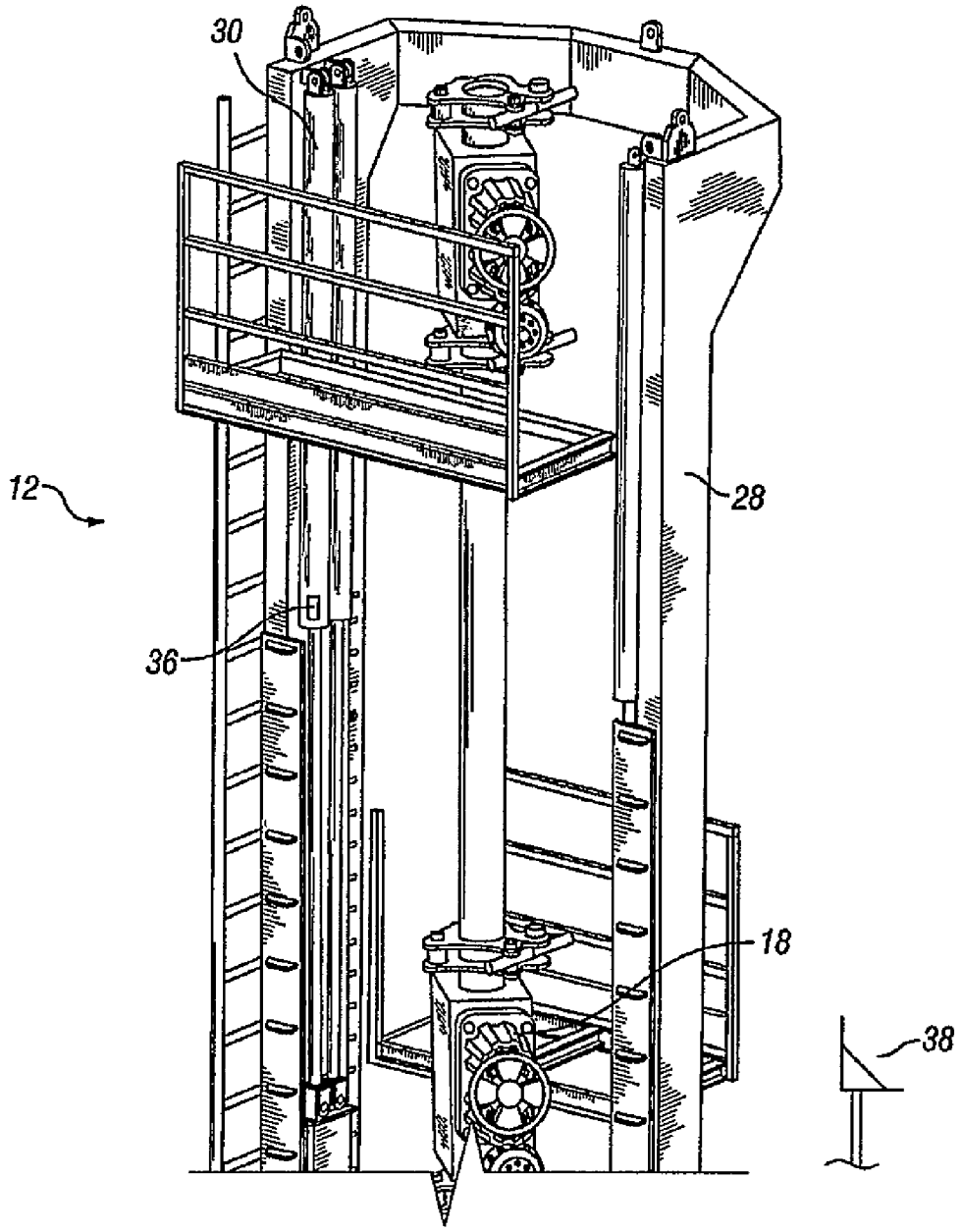
Figure 5:
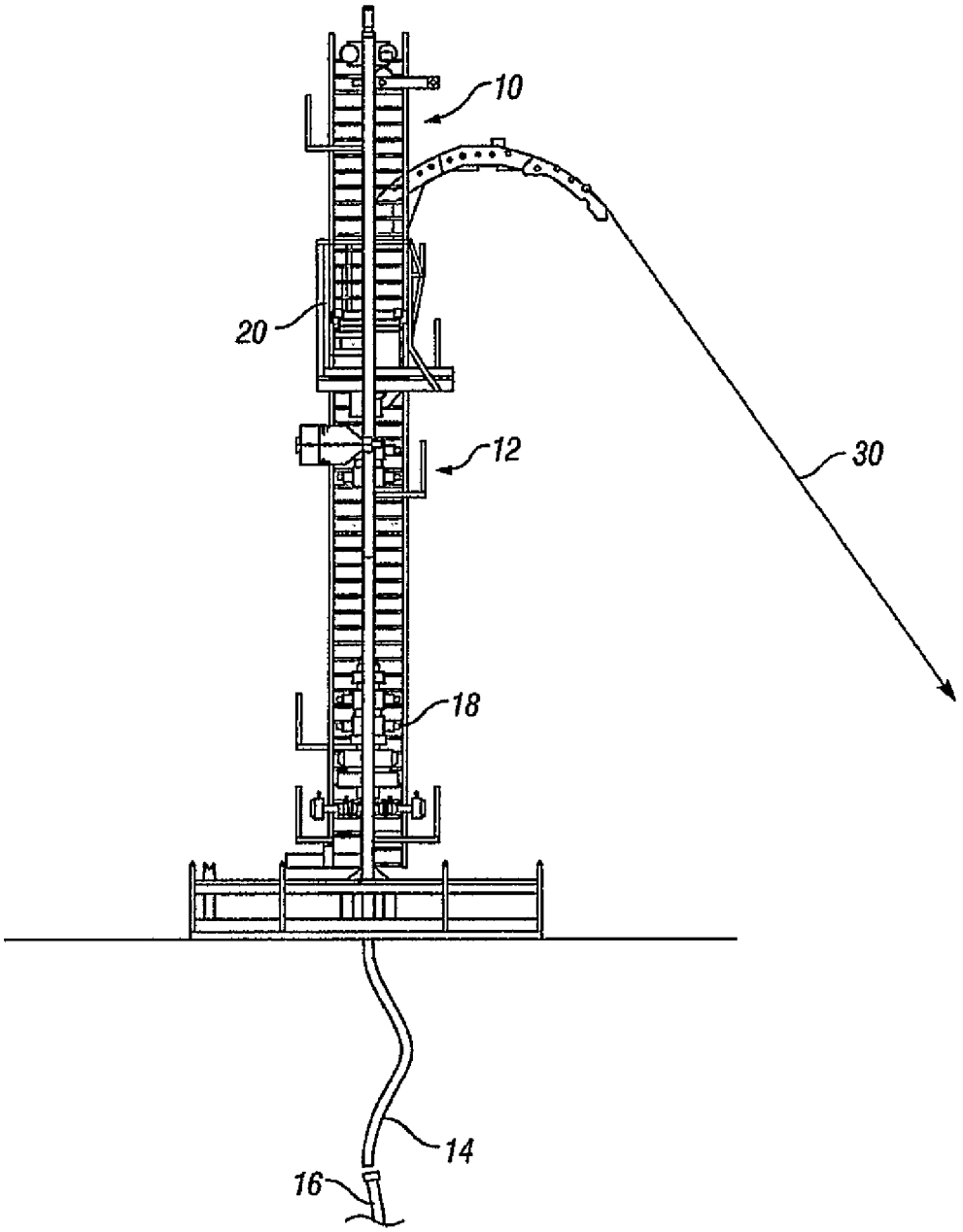
Figure 6:
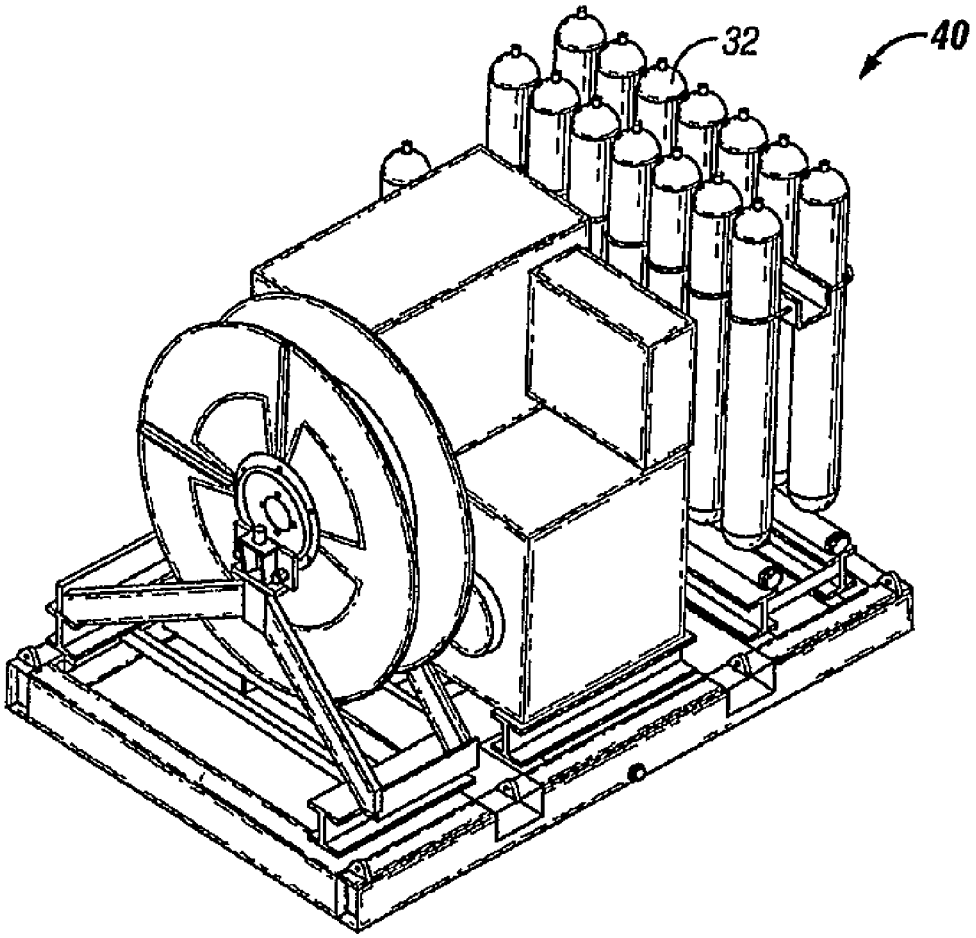
Figure 7:
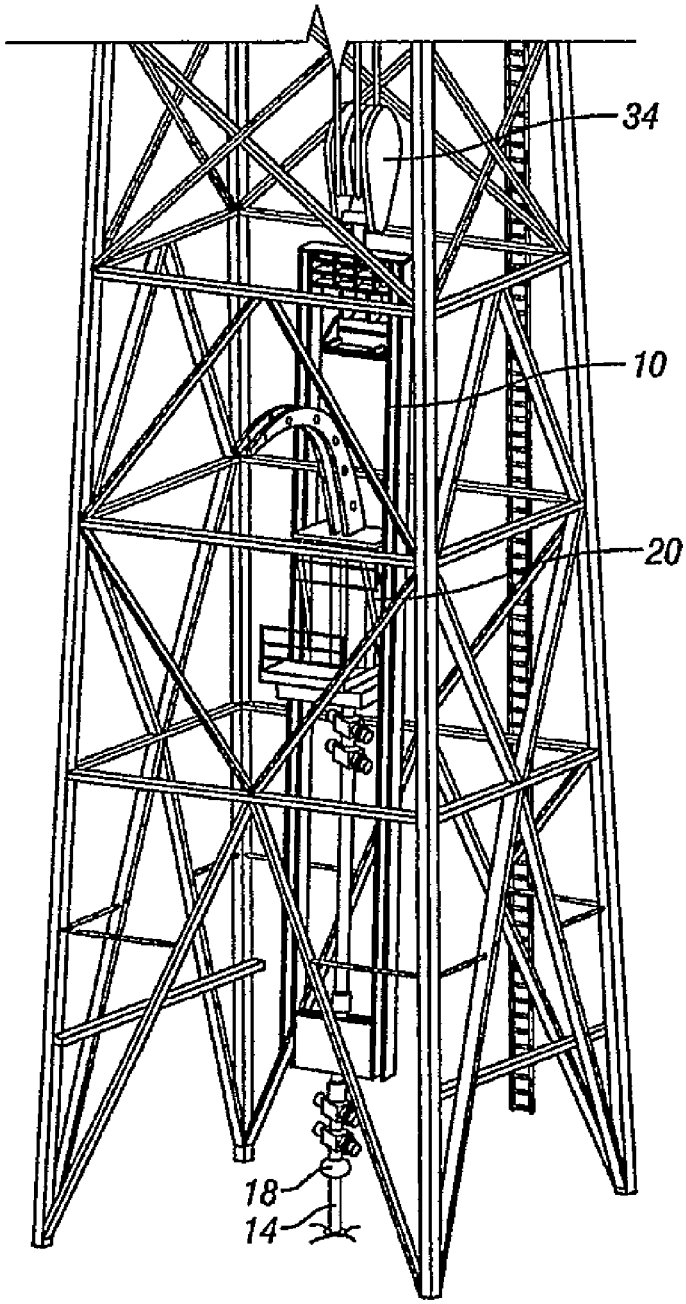

In an alternate embodiment of the present invention is an active and/or passive hook load compensator with or without the frame above. As shown in FIG. 7, the hook load compensator (not shown) may use one or more hydraulic cylinders arranged or positioned between the top of the injector 20 (such that they can carry some or all of the stack weight and tubing weight) and the rig crane or blocks 34. More preferably two or more cylinders are used for redundancy. These cylinders may also be provided with an arrangement of chains and/or cables to change the ratio of cylinder stroke to injector stack motion. The unloaded side of these cylinders may be connected to a low pressure accumulator 32, as shown in FIG. 6, to keep moisture out of the system. Alternatively, they may also be fitted with breathers. Depending on the particular application, ram-type cylinders may also be used in conjunction with this embodiment. The pressure side of the cylinder(s) may be connected to one or more accumulators 32 (with two or more being preferred) or may be connected to a power pack 40. The accumulator(s) 32 are charged to a pressure suitable to deliver the required force on the injector stack to compensate for the weight of injector stack, BOPs and coiled tubing on the wellhead. The volume of gas in the accumulators 32 is chosen such that the change in force over the motion of the injector stack is within the acceptable operating range. If a power pack 40 is used, it can either be used in a semi-active mode or an active mode. In the semi-active mode the power pack 40 is fitted with accumulators 32 and the power pack 40 allows the gas pressure to be varied during operation to permit the load carried by the wellhead 16 to be adjusted. Either gas volume or oil volume may be adjusted to achieve a change in load. In the active mode, the pressure in the cylinders is directly controlled by a hydraulic valve such that the load on the wellhead is maintained at or below a desired level.

As previously described, the present invention may include one or more hook load compensators. Appropriate capacities for a hook load compensator are dependant on the available rating of the lifting system. A capacity of 30,000 pounds may serve to stabilize the injector stack and remove the stack weight from the wellhead but would not typically carry a significant amount of tubing load. A capacity of 150,000 pounds would allow the hook to carry all of the injector stack and tubing load, but an active or semi-active system would be required to avoid pulling up too hard on the wellhead before the tubing was lowered into the well.

Yet another alternate embodiment of the present invention is a plurality of hook load compensators angled off of vertical. This system allows the stack to sway from side to side with a controllable stiffness and may allow operations on tilting wellheads without a flexible riser system. The individual compensators may be included as previously described. If a power pack is included in the apparatus, it would preferably control all of the compensators. By adjusting the angle of the compensators and their loads it is possible to tune the vertical and horizontal stiffness separately such that the injector stack will follow the wellhead motions without unduly stressing it. Any suitable control system may be employed to manage the compensators.

Power for the compensation system may be provided by dedicated power packs. The power packs may be of any suitable design but are preferably hydraulically or electrically driven. In addition, the power packs may be supplemented by accumulator banks. Optionally, any number of cylinders in the compensation systems may be connected to an accumulator bank. Such an accumulator bank is initially charged with fluid sufficient to substantially offset the static weight of the system plus the additional coiled tubing tensile load which will be applied to the wellhead. As tubing is run into the wellhead the charge pressure is increased to keep the tensile load constant. This may be done by adding fluid to the system. Adding fluid will typically change both the load intercept and spring rate. To accommodate these changes, the size of the accumulators may be adjusted such that they are large enough that system performance is not degraded. The cylinders may also be connected to a hydraulic system, controller and a sensor to detect the load in the riser connected the BOPs and the wellhead. The controller uses the hydraulic system to apply pressures to either side of the remaining cylinders to compensate for rapid variations in the load applied by the injector. Alternatively, the accumulators may be charged or discharged in such a manner to provide sole support for the injector stack, BOPs, etc.

A third alternative for providing load compensation is to have the active control system carry most or all of the load wellhead. An active system uses one or more load measuring devices 36 to measure load on the riser. Preferably, the load measuring devices 36 are strain gauges or load cell(s); however, any suitable load measuring device 36 may be used. An alternative mechanism for determining load on the system uses the known weight of the injector stack and the measured weight of the coiled tubing hanging from the injector for control. A computer or other analog control system 38 controls hydraulic pressure to maintain load at a set point or according to a characteristic curve of load versus motion.

The upper component 26 of the frame 10 carries the injector and provides a mechanism for transferring the coiled tubing load or pull to the columns of the frame. In a preferred embodiment, the injector is able to move up and down independently of the BOPs, while remaining coupled to the BOPs during normal operations. The mechanism that allows movement the injector may either freewheel or go slack when the injector is moving with the BOPs, or it may contribute some part of the compensation load. Vertical injector motion may be achieved using winches, rack and pinion drive, chains (either moving chains or as a flexible rack), screws, or any other suitable mechanism. A bearing arrangement may be needed between the injector carrier and the lift frame structure to allow for unimpeded movement. This bearing arrangement may be greased steel on steel, anti-friction pads, rollers, hydrostatic bearings, or any other suitable mechanism. Horizontal motion is done with similar techniques. Rotating the injector may be accomplished using a bearing or as discrete attachment positions. Preferably, a crane slewing bearing with a gear cut into one race is used. A motor drives this gear, allowing the injector to be rotated. An alternative embodiment is a greased steel on steel (or anti-friction padded) bearing and hydraulic cylinders or winches to rotate the injector.

Additional features, such as the injector being able to move off of the BOP center line to allow tools to be installed or other services to access the well, winches for moving the injector in and out of the frame, etc. may also be incorporated into the system. If the frame is divided into two parts, the parts should be provided with one or more winches to allow the upper part to be placed in the rig blocks and then have the lower part be pulled up and attached together. This provides a significant safety improvement over current lifting frame operations. Another safety improvement is the ability to transport the injector within the tension frame. This eliminates the difficult task of inserting the injector and BOPs into the frame in the derrick or onto a jacking frame on the workover deck. The fact that the tension frame may be split, or disassembled into two halves allows for the weight to be reduced to manageable levels for the platform cranes.

Figure 4:
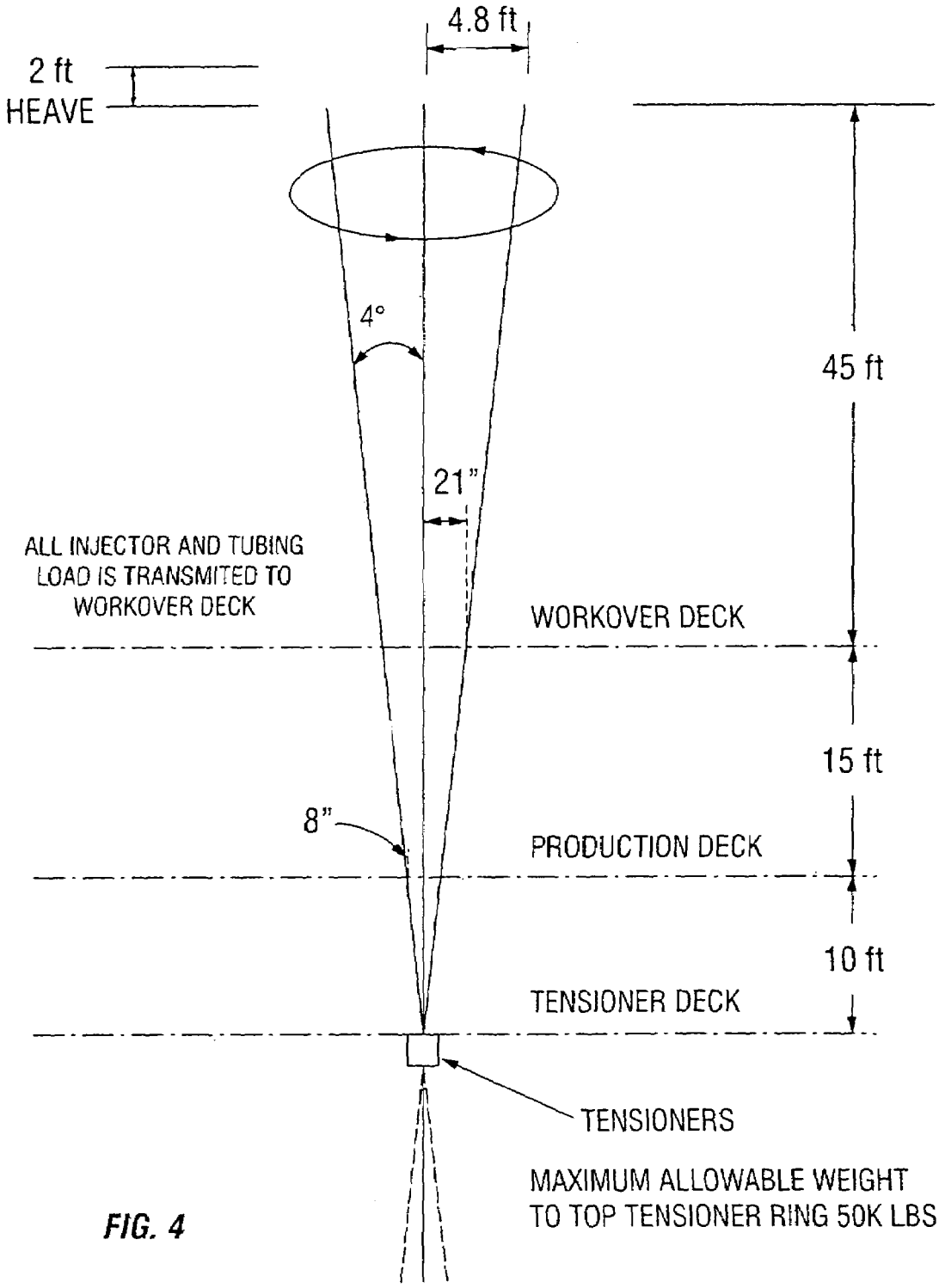
FIG. 4 is a riser motion diagram.

The flexible riser section 14 is typically used for operations conducted on TLPs and similar platforms where the wellhead moves in relation to the rig deck and BOPs. It can also be used on fixed platforms by allowing the equipment to be spotted on the deck without requiring increased accuracy to match the wellhead centerline and without needing complex X-Y translation systems to align the riser with the wellhead centerline, as shown in FIG. 4. One feature of the flexible riser is that it is capable of some angular misalignment between the BOPs and the wellhead. Six degrees of movement is sufficient for most operations; however, the riser section may allow more or less movement, depending on the specific application. There are many embodiments of this riser; flexible metal pipe (titanium, for instance), composite pipe, Coflexip type flexible pipe, and pressure containing spherical joints. Flexible pipe is the preferred, as spherical joints require larger bore diameters to clear a given tool diameter. The flexible riser bore is preferably larger than that of the BOPs and/or the wellhead to allow sufficient internal clearance for a relatively stiff coiled tubing tool to pass through the bend.

Yet another embodiment of the flexible riser employs a section of large diameter coiled tubing which is used as a riser. Such a riser would have a specific, limited, fatigue life, but would be relatively inexpensive to manufacture.

In yet another embodiment, a BOP may be placed directly on the wellhead along with a pressure containing, quick release connector. If an emergency disconnect is required, the tubing can be cut and held by the lower BOP, the riser can be drained, and the quick connector released. At this point, the wellhead can move as required without needing to move the coiled tubing stack. Alternatively, a device that can seal around the coiled tubing as it moves could also be fitted on the lower BOP stack. In this case, it would be possible to seal off around the coiled tubing and release the quick connector. As long as the coiled tubing is maintained in tension, it could slide in and out of the well freely. The drawback to using this for normal operations is that the coiled tubing tool would be difficult to install, and the initial section of running in to a well requires the injector to actually push the tubing into the well, until the weight of the tubing exceeds the pressure force. With the long unsupported length, the tubing could easily buckle during this phase.

When used in conjunction with the compensating system previously described the flexible rise allows compensated movement of the BOPs, injector stack and coiled tubing loads in relation to the wellhead. In this way, the system is able to handle or control movement for the rig, the wellhead and or the injector stack/BOPs.

We claim:

1. A system for reducing the effects of heave movements of a wellhead in an offshore drilling device comprising:

a frame;

a coiled tubing stack supported by the frame;

a heave compensation system for controlling an amount of load transferred from the coiled tubing stack to the wellhead to reduce relative movements between the coiled tubing stack and the wellhead;

a flexible riser section for connecting the coiled tubing stack to the wellhead in a manner that allows for angular misalignment between the coiled tubing stack and the wellhead; and a system for monitoring the load on the wellhead and activating the heave compensation system when predetermined load limits are exceeded.

2. The system of claim 1 wherein said frame comprises at least two legs.

3. The system of claim 1 wherein said frame comprises an upper and a lower section movable relative to each other such that the frame may be compacted thereby decreasing the space require to transport the frame.

4. The system of claim 1, wherein said heave compensation mechanism is positioned in said lower section.

5. The system of claim 1, wherein said heave compensation mechanism comprises an accumulator.

6. The system of claim 5, further comprising a plurality of accumulators.

7. The system of claim 1, wherein the flexible riser section is connected to the wellhead above the sea level.

8. The system of claim 7, wherein the flexible riser section comprises a flexible pipe.

9. The system of claim 7, wherein the flexible riser section comprises a pressure containing spherical joint.

10. The system of claim 1, wherein said frame supports the load of a BOP and coiled tubing injector and dynamic weight of coiled tubing.

11. The system of claim 8, wherein the flexible riser section comprises a flexible metal pipe that is connected to the wellhead above the sea level.

12. A method of reducing the effects of heave movements of a wellhead in an offshore drilling device comprising:

providing a frame which supports a coiled tubing stack;

positioning the frame proximate to the wellhead;

providing a heave compensation system for controlling an amount of load transferred from the coiled tubing stack to the wellhead to reduce relative movements between the coiled tubing stack and the wellhead;

monitoring the load on the wellhead; and activating the heave compensation system when predetermined load limits on the wellhead are exceeded.

13. The method of claim 12, further comprising providing a flexible riser section, which connects the coiled tubing stack to the wellhead in a manner that allows for angular misalignment between the coiled tubing stack and the wellhead.

14. A system for reducing the effects of heave movements of a wellhead in an offshore drilling device comprising:

a frame;

a coiled tubing stack supported by the frame; and a heave compensation system for controlling an amount of load transferred from the coiled tubing stack to the wellhead to reduce relative movements between the coiled tubing stack and the wellhead.

* * * * *

UNITED STATES PATENT AND TRADEMARK OFFICE

CERTIFICATE OF CORRECTION

PATENT NO. : 7,063,159 B2
APPLICATION NO. : 10/809256
DATED : June 20 2006
INVENTOR(S) : Patton et al.

It is certified that error appears in the above-identified patent and that said Letters Patent is hereby corrected as shown below:

Enclosed are formal drawings for Figs. 1, 3 and 5-7 to replace informal drawings 1, 3 and 5-7.

Signed and Sealed this

Sixth Day of February, 2007

JON W. DUDAS
*Director of the United States Patent and Trademark Office*

1/7

5/7

6/7

7/7